US005086379A

United States Patent [19]

Denison et al.

[11] Patent Number: 5,086,379

[45] Date of Patent: Feb. 4, 1992

[54] LOW VOLTAGE OUTDOOR FLOODLIGHT HAVING ADJUSTABLE BEAM PATTERN, BALL AND SOCKET MOUNTING, AND NOVEL CABLE HANDLING

[75] Inventors: John F. Denison, Lake Villa; John A. Czerlanis, Solon Mills, both of Ill.; Ronald L. Sitzema, Ellsworth, Mich.

[73] Assignee: Intermatic Incorporated, Spring Grove, Ill.

[21] Appl. No.: 387,473

[22] Filed: Jul. 31, 1989

[51] Int. Cl.[5] ..... F21S 1/02

[52] U.S. Cl. ..... 362/145; 362/285; 362/391; 362/430; 362/431; 403/114; 248/288.3; 439/391; D26/67

[58] Field of Search ..... 362/145, 269, 285, 287, 362/372, 289, 418, 427, 428, 429, 430, 431, 391, 152, 368; 439/13, 414, 419, 374, 375, 387, 389, 391; 403/114, 117; 248/288.3; D26/67, 68

[56] References Cited

U.S. PATENT DOCUMENTS

| | | | |
|---|---|---|---|
| 788,035 | 4/1905 | Fergusson | 403/114 |
| 1,186,428 | 6/1916 | Newman . | |
| 1,631,480 | 6/1925 | Freund | D26/29 |
| 1,778,658 | 10/1930 | Baker | 403/114 |
| 2,041,847 | 5/1936 | Marchand | 248/288.3 |
| 2,085,614 | 6/1937 | Stowick | 362/285 |
| 2,185,012 | 12/1939 | Blazier . | |
| 2,231,565 | 2/1941 | De Reamer et al. . | |
| 2,928,934 | 3/1960 | Atkin | 362/372 |
| 3,299,263 | 1/1967 | Bjontegard . | |
| 3,501,627 | 3/1970 | Macemon . | |
| 3,778,610 | 12/1973 | Wolf | 362/418 |
| 3,798,668 | 3/1974 | Hartmann . | |
| 4,414,612 | 11/1983 | Conforti et al. | 362/188 |
| 4,414,613 | 11/1983 | Mayer | 362/372 |
| 4,419,720 | 12/1983 | Kenney | 362/285 |
| 4,492,488 | 1/1985 | Warshawsky | 248/288.3 |
| 4,509,106 | 4/1985 | Mayer et al. | 362/287 |
| 4,521,836 | 6/1985 | Puttemanns et al. | 362/145 |
| 4,675,794 | 6/1987 | Fink, Jr. et al. | 362/289 |
| 4,719,549 | 1/1988 | Apel | 362/398 |
| 4,729,065 | 3/1988 | Bahnemann et al. | 362/18 |
| 4,742,436 | 5/1988 | Hoggett | 362/80 |
| 4,760,508 | 7/1988 | Burrello et al. | 362/372 |
| 4,774,648 | 9/1989 | Kakuk et al. . | |
| 4,779,177 | 10/1988 | Ahrori | 439/391 |
| 4,870,548 | 9/1989 | Beachy et al. | 362/277 |

*Primary Examiner*—Ira S. Lazarus
*Assistant Examiner*—D. M. Cox
*Attorney, Agent, or Firm*—Willian Brinks Olds Hofer Gilson & Lione

[57] ABSTRACT

A light fixture having a base coupled to a housing by means of a coupling of the ball and socket type. The light housing may be fixed in any angular orientation over a range of azimuth angles well in excess of two hundred and seventy degrees and any angle of elevation from completely horizontal to completely vertical. The coupling can do so while accommodating the passage of electrical conductors from the base of the fixture extending toward the lamp and while also protecting the fixture against misuse in the form of repeated rotation tending to disconnect those conductors internally of the fixture. Altering the relative positions of a lamp and reflector changes the width of the beam cast by the apparatus. With the reflector and front lens fixed, a lamp holder is mounted for sliding motion with respect to the rear of the housing and is moved by manual actuation of a mechanism accessible from the rear of the fixture. A mounting for connecting the fixture to a ground spike provides for the housing to be mounted an appropriate distance above the ground, yet the power supply cable need not be elevated to the level of the housing in order to provide power to the light fixture.

16 Claims, 4 Drawing Sheets

LOW VOLTAGE OUTDOOR FLOODLIGHT HAVING ADJUSTABLE BEAM PATTERN, BALL AND SOCKET MOUNTING, AND NOVEL CABLE HANDLING

FIELD OF THE INVENTION

The present invention relates to a lighting fixture and in particular, but not exclusively, to a low voltage outdoor floodlight.

BACKGROUND OF THE INVENTION

Outdoor floodlights have been known for many years. Some are designed for mounting near the ground, on the ground or even underground. Others are designed for mounting at a height, as on the side of a building or on a pole. In both types of apparatus, it is common to provide a mechanism in the mounting whereby the direction of the light may be adjusted, at least to a limited degree. A common manner in which such is accomplished is by providing a connection between the light fixture and a fixed mounting therefor, according to which the fixture may be moved relative to the mounting and then secured against motion.

In mountings of this type, it is common for the available range of motion of the fixture to be rather limited. One attempt to expand the range of adjustment has involved the use of a ball captured between two sheet metal parts. Each of the sheet metal parts has a hole of a diameter smaller than the diameter of the ball and in which the ball rests. By forcing the plates toward each other, as by the use of bolts or the like, one may cause the ball to be gripped and held in position. However, even with this type of mounting the available range of motion is too limited.

Another aspect of outdoor floodlights pertains to those mounted proximate the ground, as on a spike or the like fixed in the ground. When such equipment has been provided for sale to and installation by the general consumer, purchasers have often encountered difficulty in the proper technique of laying out and installing a plurality of lights interconnected by a power cord. The difficulty arises from the facts that such lights have historically being designed for making an electrical connection between the cable and the housing at a location several inches above the ground. Because the cable must extend upwardly to the housing and then back down at each of the several fixtures, the length of cable needed may be significantly longer than the length of the entire array of fixtures as measured along the ground. Consumers tend not to account for this difference in planning and implementing the initial stages of installation. For example, a consumer who connects the cable to each light fixture in advance of mounting any of the equipment in the ground may discover that the lights may not be spaced apart the distances that have been intended. Other improper methods of installation exist that can lead to a similar difficulty. A lighting fixture is needed that is effective in avoiding such difficulty.

According to yet an additional aspect of floodlights, it has been known to provide a two-part housing in which the lamp is fixed to the rear housing, the reflector is mounted on the front housing, and the front and rear housings are mated with screw threads or the like for purposes of providing adjustability. In particular, twisting the front housing with respect to the rear housing moves the reflector forwardly and rearwardly with respect to the lamp, thereby changing the light pattern cast by the floodlight.

Such lights typically are provided with lenses mounted to the front housing and having an array of square or rectangular focusing elements distributed over a surface thereof. In such cases, the aspect ratio of the sides of the focusing elements determines the aspect ratio of the shape of the beam that is cast by the fixture as a whole. The result is that, when the front housing is rotated so as to reposition the reflector, the lens is rotated through the same angle, thereby causing the parallel tops and sides of the beam to move out of alignment with the local vertical. Accordingly, additional mechanism must be provided in the front housing to allow one to reposition the lens with respect to the front housing after the front housing has been twisted in accord with the previous paragraph. A simpler, less expensive way of adjusting the beam is needed.

SUMMARY OF THE INVENTION

The current invention provides a light fixture having a base coupled to a housing by means of a coupling of the ball and socket type. With the base mounted for example in a vertical orientation, the coupling provides for the ability to fix the light housing in any angular orientation over a range of azimuth angles well in excess of two hundred and seventy degrees and any angle of elevation from completely horizontal to completely vertical. The coupling can do so while accommodating the passage of electrical conductors from the base of the fixture toward the lamp and also while protecting the fixture against complete azimuthal rotations which, if repeated, would tend to disconnect those conductors internally of the fixture.

The current invention provides an improved means for changing the relative positions of a lamp and reflector for altering of the width of the beam cast by the apparatus. With the reflector and front lens fixed, a lamp holder is mounted for forward and rearward movement with respect thereto. The lamp holder is mounted for sliding motion with respect to the rear housing and is moved by actuation of a thread-like mechanism having a large pitch this mechanism being actuated manually by turning a turn button accessible from the rear of the fixture.

According to a further aspect of the current invention, there is provided a mounting for connecting the fixture to a spike or similar ground engaging element according to which the housing of the fixture is desirably mounted an appropriate distance above the ground, yet the power supply cable need not be e)evated to the level of the housing in order to provide power to the light fixture. In this way, a power supply cable may remain proximate the ground, thereby facilitating installation by the general consumer.

DETAILED DESCRIPTION OF THE PREFERRED EMBODIMENT

Figure 1:
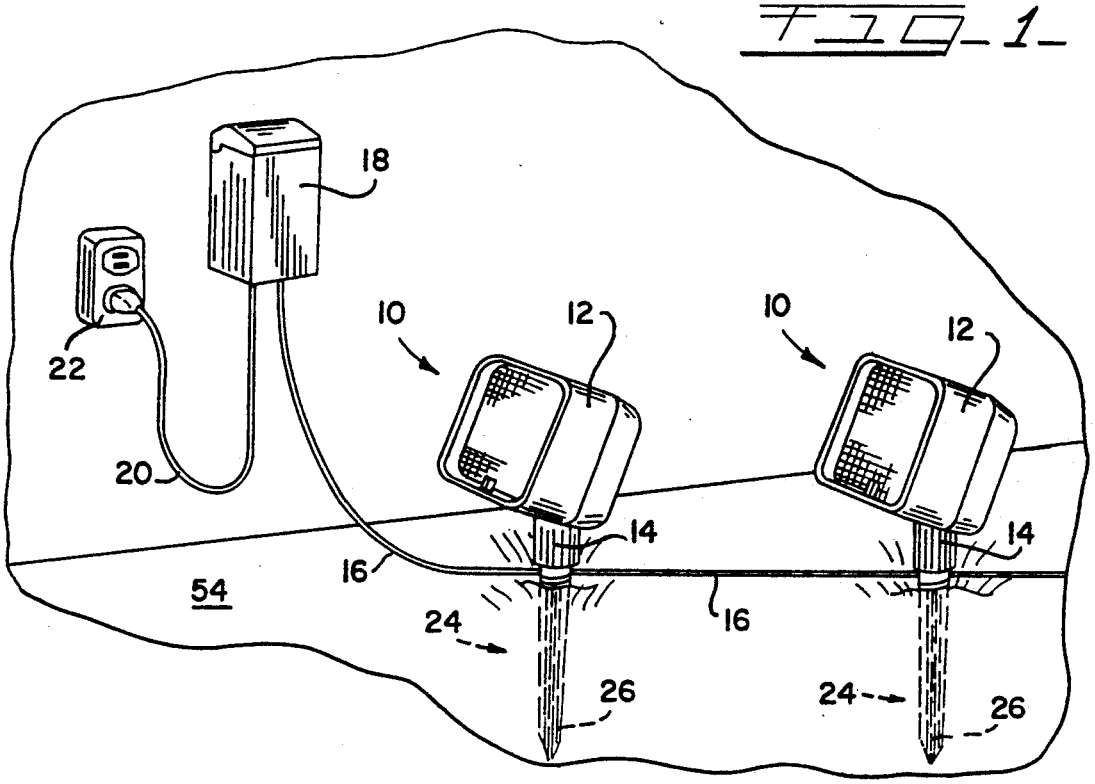
FIG. 1 shows two liqht fixtures according to the current invention in an environment in which they are adapted to be used.

FIG. 1 shows two light fixtures 10, each comprising a housing 12 and a base 14.

Preferably, the light fixtures 10 are outdoor floodlights, provided with electric power through a cable 16. More preferably, the fixtures 10 are floodlights of the low voltage type, the cable 16 being connected to a source of low voltage direct current such as wall-mounted transformer 18, which in turn may be provided with alternating current via a power cable 20 from an AC fixture 22 or the like.

Figure 2A:
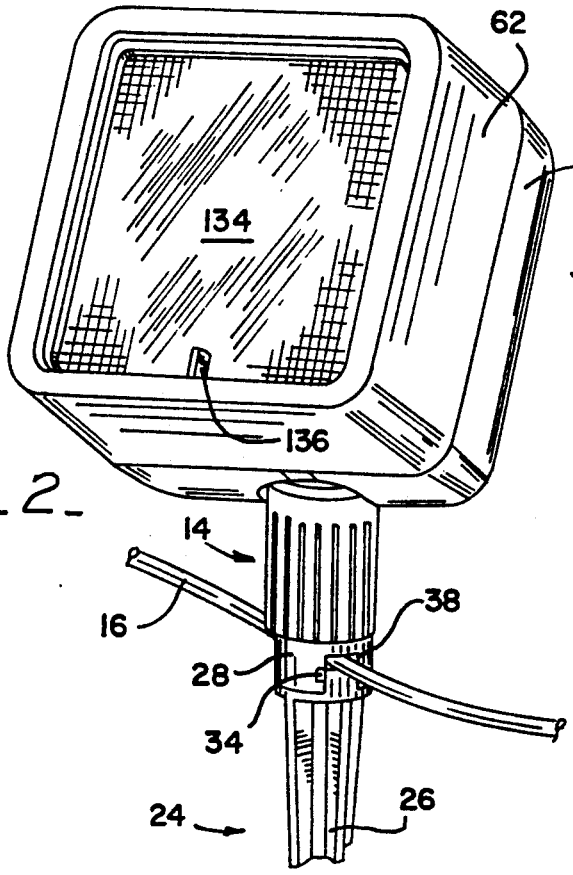
FIG. 2A is an enlarged fragmentary perspective of a mount, seen from the same direction as in FIG. 2.
Figure 2:
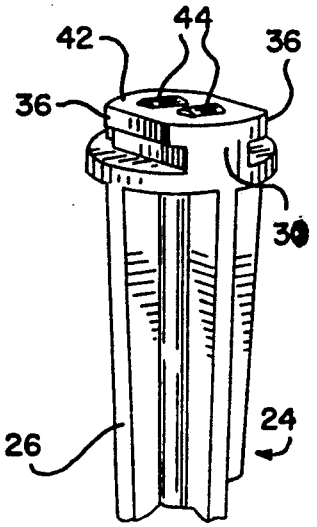
FIG. 2 is a right front perspective of a light fixture according to the current invention, mounted on a mount having a ground-engaging spike and being electrically connected to a power supply cable.
Figure 3:
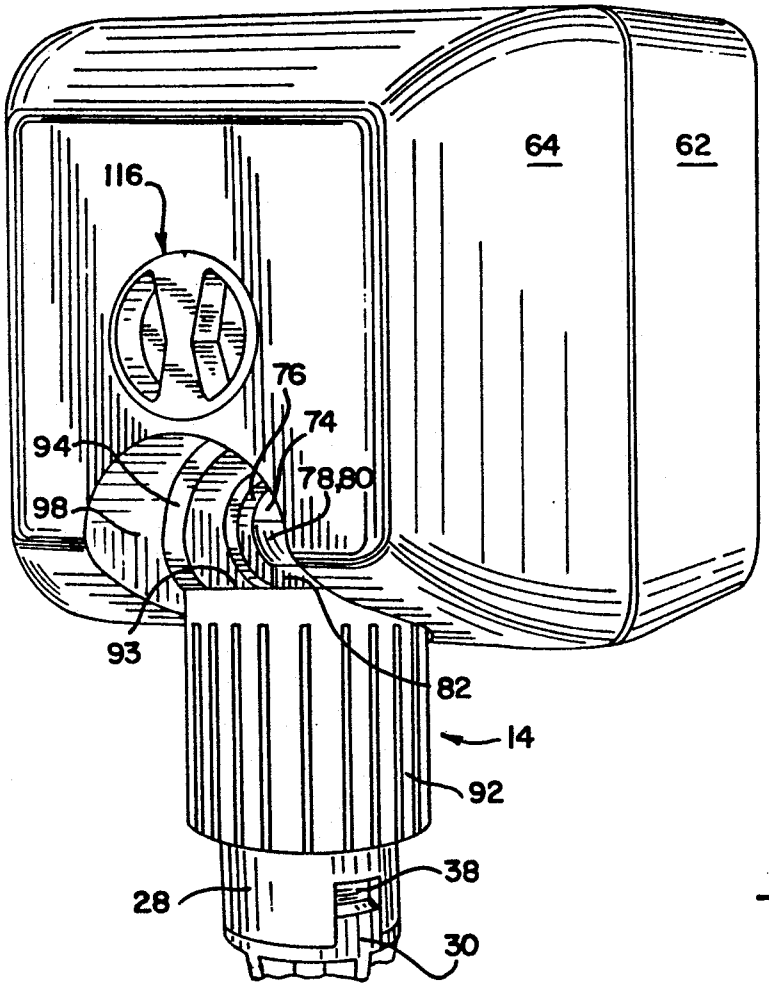
FIG. 3 is a right rear perspective similar to that of FIG. 2, with the lamp housing oriented for horizontal illumination.

As shown in FIG. 1 and in more detail in FIGS. 2 and 3, the fixtures 10 are adapted to cooperate with mounts 24, the upper portion of a mount 24 being shown in perspective in FIG. 2A. Each mount 24 is provided with a ground engaging element, preferably in the form of a spike 26. As will now be explained, interlocking means formed on the mount 24 and base 14 fixedly support the base 14 on the mount 24.

Figure 5:
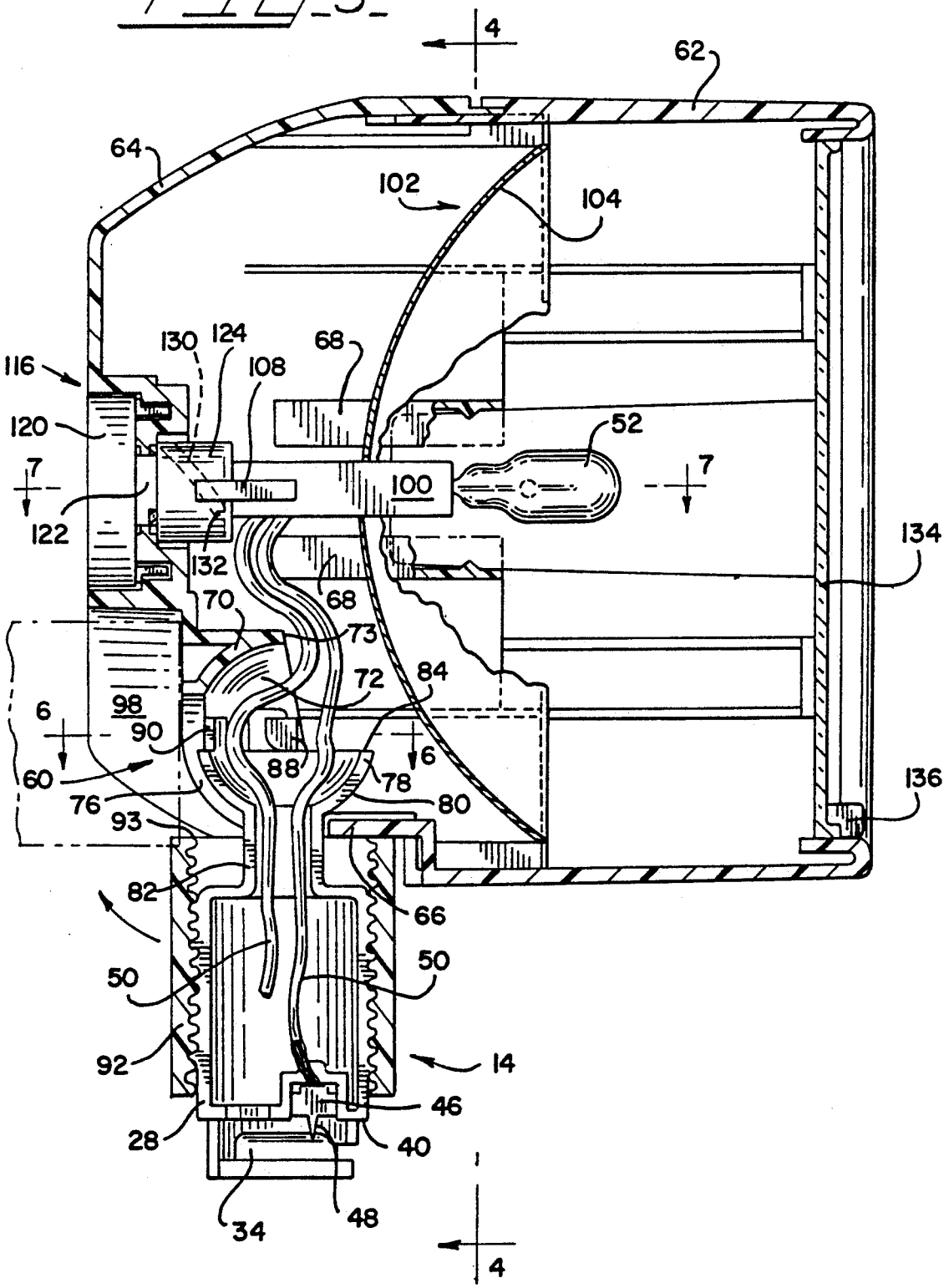
FIG. 5 is a left elevation, partly in cross-section, shoWing the interior of a housing and base according to the current invention.

As shown in FIGS. 2, 3 and 5, the base 14 of a light fixture 10 includes a post 28. The post 28 is slidingly received on contoured head 30 of mount 24. A sliding and retaining mating of the post 28 and head 30 is provided by a tongue and groove arrangement, preferably in the form of a T-shaped cross-section 32 received in a correspondingly-shaped groove 34. In the illustrative embodiment, the T-shape is formed on the head 30 of mount 24, and the groove 34 is formed in the post 28. Oppositely-disposed wings 36 of the T-shape 32 and their corresponding portions of the groove 34 are visible in FIGS. 2 and 2A, but not in FIG. 3. This is because they do not extend for the entire diameter of the post 28. By terminating inwardly of the post 28, they form a stop which limits the relative sliding motion of the mount 24 and post 28. This forms a convenient stop to provide proper centering of the post 28 on the mount 24.

When the post 28 and mount 24 are mated, they define therebetween a passage 38 having a width approximately the same as the diameter of the cable 16 and a depth slightly less than the diameter of the cable 16, so that the cable 16 is compressed therebetween. For example, the cable 16 may be compressed between a surface 40 of the post 28 (FIG. 5) and a surface 12 of the mount 21 (FIG. 2A). If desired, this compression may be aided by one or more raised portions 44, formed for example on the surface 42 of mount 24.

FIG. 5 shows one of two electrically conductive plates 46 that are mounted and held in place by the post 28. Each plate 46 is provided with a point 48 extending well into the groove 34, preferably across substantially the entire passage 38 The points 48 penetrate the cable 16 and make electric contact with respect to conductors in the cable 16. From the plates 46, electric power may pass up conductors 50 and ultimately to lamp 52, as will be explained more fully below.

It may be seen that compressing the cable between the mount 24 and post 28 of base 14 serves to provide mechanical integrity for the electrical connection between the cable 16 and the light fixture 10. Moreover, it provides for the electrical connection with the cable 16 to be disposed a distance below the housing 12 that substantially corresponds to the height of the base 14. With the mount 24 disposed in the earth 54 as shown in FIG. 1, it may be seen that the cable 16 remains proximate the ground while providing power to a plurality of fixtures 10, without the necessity of using extra cabling to rise to the level of each housing 12, the latter being disposed above the ground by a height roughly equivalent to the height of the base 14.

According to another aspect of the current invention, the housing 12 and base 14 are joined together at a ball and socket coupling 60. Various views of this coupling are shown in each of the FIGS. 3-6. One portion of the coupling 60 is integrally formed as a portion of the housing 12. Preferably, the housing 12 comprises a front housing 62 and a rear housing 64, rearwardly extending legs 66 of the front housing 62 being slidingly received in tracks 68 formed on the rear housing 64 for the mating of the front and rear housings.

Rear housing 64 defines an integrally molded first member 70 of the ball and socket coupling 60. Formed on the first member 70 is a concave surface 72 that is generally spherical but is discontinuous because of openings provided therein. As shown in FIG. 5, the concave surface 72 is slightly more than a hemisphere and faces substantially in the direction that light shines from the fixture 10. It terminates in a substantially diametric plane at a surface 73. Herein, a partial spherical surface will be termed a spherical segment.

Figure 4:
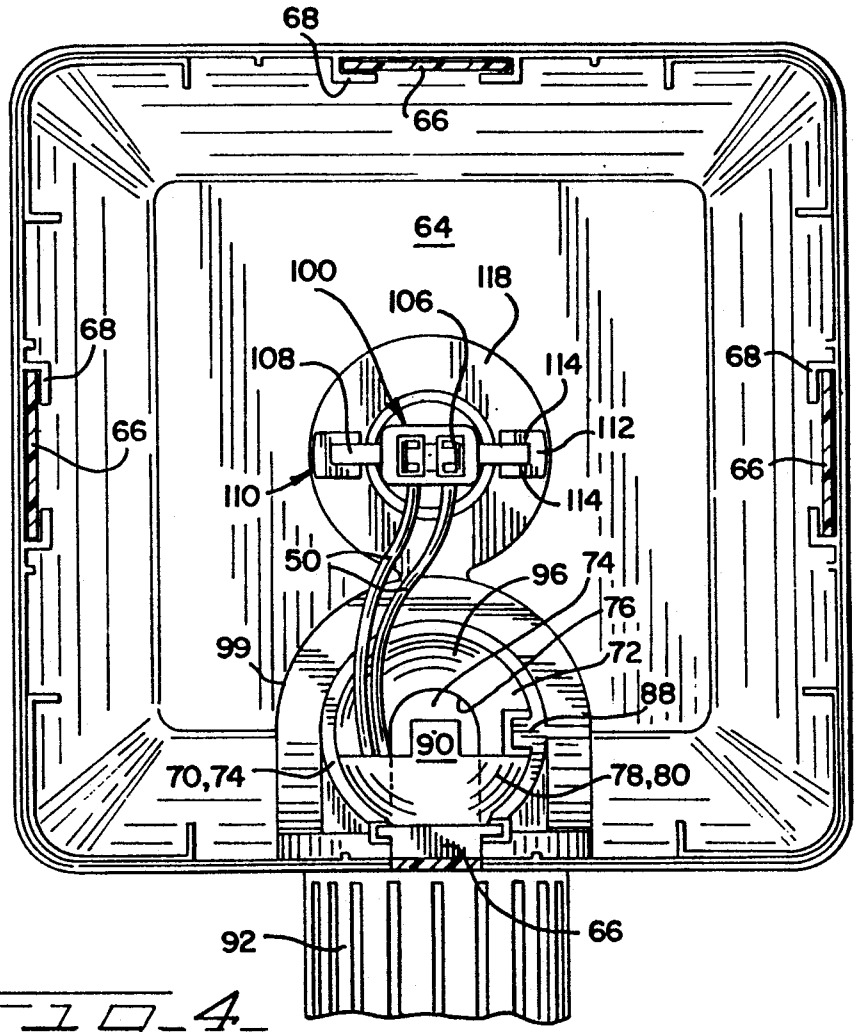
FIG. 4 is a front elevation taken along line 4—4 of FIG. 5, the lamp and reflector having been removed.

As seen in FIGS. 3, 4 and 5, a rear portion of the concave surface 72 and first member 70 is interrupted by an arcuate base-receiving channel 74, so-called because it receives a portion of the base 14, as described below. For the present, it will be noted that the base moves within this channel when the relative positions of it and the housing 12 are changed from the orientation shown in solid lines in FIGS. 3-6 to the orientation shown in phantom in FIGS. 5 and 6. Accordingly, the base-receiving channel 74 includes a portion opening generally to the rear, visible in FIGS. 3 and 4, and a similar portion opening generally downwardly. Reference numeral 76 designates side walls of the base-receiving channel 74.

A second portion of the ball and socket coupling 60 is formed of a second member 78 having a convex surface 80 formed thereon and disposed in opposition to the concave surface 72. Extending downwardly from the second member 78 in FIG. 5 is a neck 82 that penetrates and moves within the base-receiving channel 74. The neck 82 is integral with the post 28 described above. Like the concave surface 72, the convex surface 80 takes the shape of a spherical segment terminating in a substantially diametric plane 84. It may be seen from FIG. 5 that when the base 14 is in the configuration shown in solid lines, approximately one-half of the convex surface 80 is opposed to approximately one-half of the concave surface 72. When the base 14 is in the position shown in phantom in FIG. 5, the surfaces 72 and 80 are substantially entirely opposed.

The element comprising post 28, neck 82 and second member 78 may conveniently be made of two molded halves adapted to be brought together along flat, longitudinally extending surfaces after the electrical conductors 50 and conducting plates 46 have been introduced. The flat surface of one such half is shown in FIG. 5.

Figure 6:
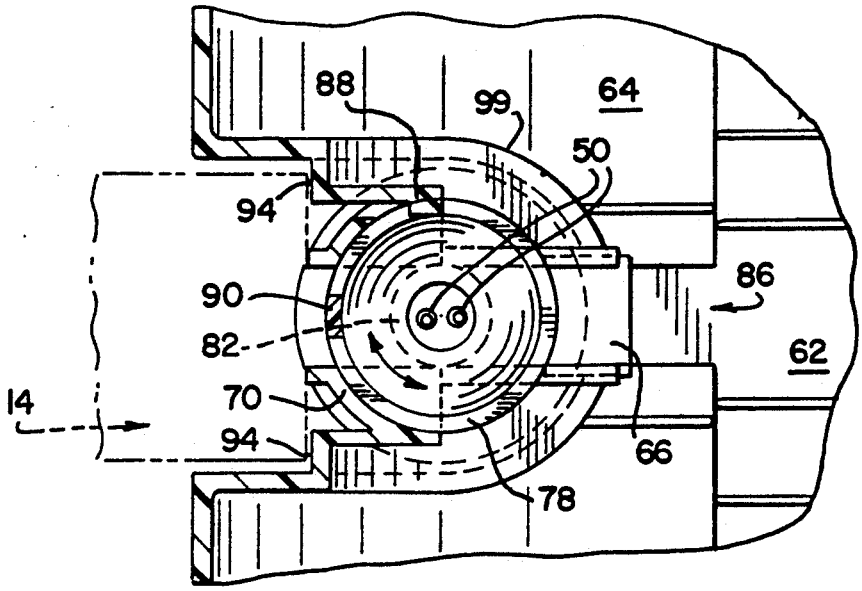
FIG. 6 is a vertical plan view taken along line 6—6 of FIG. 5.

As shown in FIGS. 5 and 6, a specially-shaped lower one of the front housing legs 66 is provided with an arcuate end surface and extends rearwardly a sufficient distance to abut the neck 82 of the base 14. Before such a meeting occurs, the ball and socket joints may be assembled by passing the neck 82 along a channel 86 formed in the bottom of the rear housing 64.

The post 28, neck 82 and second member 78 are substantially hollow to provide for the reception of the electrical conductors 50. It may be seen that, with the fixtures 10 mounted as shown in FIG. 1, the possibility would exist of someone's ripping loose the internal connections of the electrical conductors 50 by the act of repeatedly twisting the housing 12 about a vertical axis in the same direction. To prevent this, stops are provided as adjuncts to the ball and socket joint.

In particular, a first stop 88 extends from the first member 70 radially inwardly with respect to the concave surface 72. A second stop 90 extends from the second member 78 in a direction generally parallel to the geometric axis of rotation of the convex surface 80. With the stops 88, 90 configured as described and shown in FIGS. 4–6, they will contact each other upon continued rotational motion of the housing 12 with respect to its base 14, no matter what the elevational angle of the housing 12 with respect to the base 14. In this manner, the stops 88, 90 serve to protect the electrical connections of the conductors 50. Naturally, if one desired the ability to provide for a complete 360° rotation of the housing 12 with respect to the base 14, eliminating the stops 88, 90 would be one method of accomplishing that result.

As shown in FIG. 5, a threaded member 92, hereafter called a nut, is received onto corresponding threads of the post 28. When the nut 92 is turned with respect to the post 28 in such a direction that nut 92 approaches the housing 12, an upper surface 93 of nut 92 may contact a stop surface 94 that is formed on rear housing 64. The stop surface 94 is curved and generally follows the disposition of the arcuate base-receiving channel 74. That is, a portion of the stop surface 94 faces generally rearwardly of the housing 12, and a portion of the stop surface 94 faces generally downwardly of the housing 12. Therefore, the upper surface 93 of nut 92 may contact the stop surface 94 in any relative angular disposition of the housing 12 and the base 14.

With continued turning of nut 92, its contact with the housing will tend to push the post 28 outwardly thereof, with the result that the opposed surfaces 72, 80 of the ball and socket joint 60 will be forced together. With sufficient tightening of the nut 92, the resulting tightening of the ball and socket joint 60 will fix the housing 12 with respect to the base 14, both in azimuth and elevation. If desired, and as shown in FIG. 4, stippling 96 or other physical irregularity may be added to one or both of the opposed surfaces in order to enhance the locking of the ball and socket joint.

A large nut-receiving well is formed in the rear housing 64 in order to provide for proper contact of the nut 92 with the stop surface 94 and also to eliminate interference between the housing 12 and nut 92, in order that the housing 12 may be oriented for a completely horizontal beam and a completely vertical beam. The nut-receiving well is defined by external surfaces 98 (FIG. 3) and internal surfaces 99 (FIG. 4).

According to a further aspect of the current invention, a lamp holder 100 penetrates a centrally-disposed opening in a reflector 102 having a parabolic reflecting surface 104. Lamp 52 is removably held in place by electric clips 106 (FIGS. 4 and 7) fixed in an open end of the lamp holder 100. Rear portions of the clips 106 are exposed to the interior of the housing 12, at which point they are connected with the electrical conductors 50.

Figure 7:
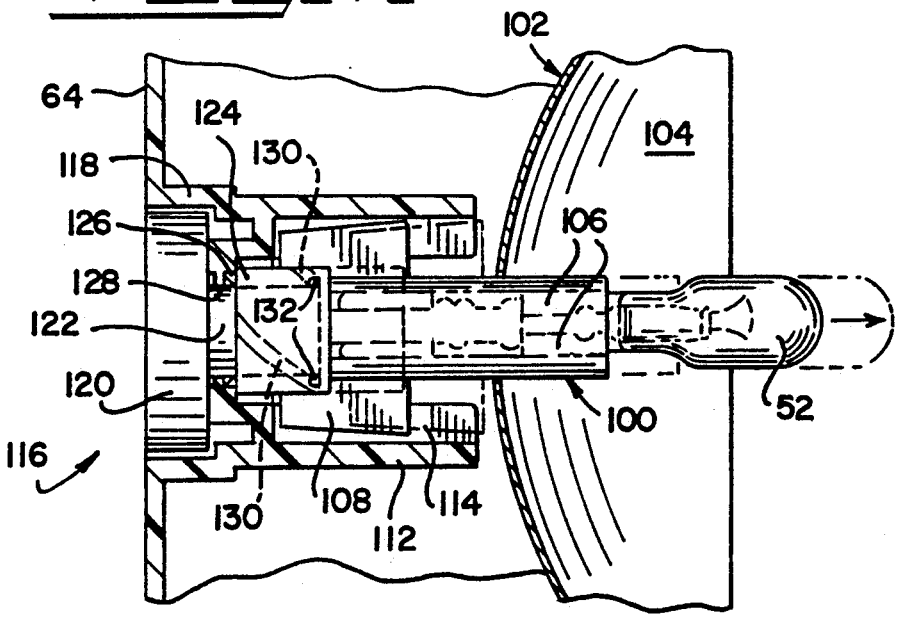
FIG. 7 is a vertical plan view, partly in cross-section, looking generally along the direction indicated by line 7—7 of FIG. 5.

As shown in FIGS. 4, 5 and 7, a pair of wings 108 extend outwardly from opposite sides of the lamp holder 100. The wings 108 are slidingly received in U-shaped channel members 110 that are fixed to the rear housing 64. The U-shaped channel members are not shown in FIG. 5, for clarity, but may be seen in end view in FIG. 4 and in longitudinal cross-section in FIG. 7. They comprise a bight portion 112 and leg portions 114.

The wings 108 and U-shaped channel members 110 serve as means for guiding the lamp holder 100 as it is moved with respect to the reflecting surface 104, back and forth, at will, between the positions shown in solid line and phantom in FIG. 7. Such motion changes the focus of the apparatus and alters the light pattern emitted from the fixture. In particular, when a light source (such as a filament) of the lamp 52 is disposed at or proximate a focus of the reflecting surface 104, a narrow beam is reflected from the reflecting surface 104. In the alternative, when the light source of a lamp 52 is displaced from the focus of the reflecting surface 104, a wide, diverging beam is reflected.

According to an aspect of the current invention, means are provided whereby the lamp holder 100 may be moved as described above by the simple expedient of manually turning a turn button 116. As shown in FIG. 3, turn button 116 is readily accessible from the rear of the housing. Turn button 116 and related structure are shown in more detail in FIGS. 5 and 7.

Turn button 116 is received in a turn button well 118 formed in the rear housing 64. It comprises a stepped cylindrical member having a portion 120 of larger diameter for direct actuation by a user and a portion of smaller diameter in the form of a shaft 122.

The shaft 122 is rotationally received within the lamp holder 100. In particular, a rear portion 124 of lamp holder 100 has a cylindrical opening formed therein that receives the shaft 122. Small tabs 126 extending radially outward from shaft 122 cooperate with an annular shelf 128 formed integrally of the housing 64 in order to retain return button 116.

Means are provided whereby rotation of the turn button.116 clockwise or counterclockwise will result in the respective rearward or forward motion of the lamp 52, as carried by the lamp holder 100. Preferably, less than one-half revolution of the turn button 116 will be effective to carry the lamp 52 across its full course of travel.

A preferred form of such means is shown in FIGS. 5 and 7. At least one, preferably two, thread-like grooves 130 are formed in an inner wall of the rear cylindrical portion 124 of the lamp holder 100. As shown, the thread-like grooves 130 extend longitudinally and circumferentially of the rear portion 124 of lamp holder 100. Received within each groove 130 is an engaging member in the form of a protrusion 132 extending radially from the shaft 122. It may be seen that rotating the turn button 116 causes the engaging protrusion to describe a circle as the shaft 122 rotates, and this in turn forces forwardly or rearwardly, as the case may be, the rear portion 124 of the lamp holder as the engaging member 132 slides in the thread-like groove 130.

It may be seen that the groove 130 resembles a thread of large pitch. In the embodiment most preferred at present, rotation of the turn button 116 through an angle of approximately one hundred thirty five degrees moves the lamp 52 over a distance of approximately 0.30 inch for parabolic reflectors having a focal length of a size typical of apparatus of this kind.

Other mechanisms for moving the lamp may be used. For example, a slide-action mechanism may be used in lieu of a turn button mechanism.

It may be seen that, during the motion of the lamp 52, the reflecting surface 104 and a lens 134 of the fixture remain fixed. Therefore, the square or rectangular focusing elements of lens 134 need not be re-positioned following a change of relative positions of the lamp 52 and reflecting surface 104.

Desirably, the refracting elements of the lens 134 are rectangular but not square, and the lens 134 is received in the front housing 62 by a press fit or the like. The lens may be removed by grasping a tab 136 and pulling it forward to free the lens from the front housing. If the lens is then turned ninety degrees and replaced, the rectangular beam will have been turned a corresponding ninety degrees.

Of course, it should be understood that a wide range of changes and modifications can be made to the preferred embodiment described above. It therefore is intended that the foregoing detailed description be regarded as illustrative rather than limiting, and that it be understood that it is the following claims, including all equivalents, which are intended to define the scope of this invention.

We claim:

1. In combination:

a base and a housing joined together along a first axis at a ball and socket coupling so that the housing is above the base, the coupling comprising a first member having a concave surface in the form of a spherical segment and being mounted for movement together with the housing, said first member having a downward-facing opening in the concave surface, the coupling further comprising a stem portion connected at a first end thereof to the base and extending upward through and movable along the downward-facing opening, a second member having a convex surface in the form of a spherical segment, the second member connected to a second end of the stem portion, the convex surface being opposed to said concave surface and being mounted for limited rotational movement about said first axis and limited rotational movement about a second axis orthogonal to said first axis, a first stop member connected to the concave surface of the first member and extending in a direction toward the second member; and a second stop member connected to the convex surface of the second member, the second stop member positioned and adapted to interfere with the first stop member whereby rotation of the second member and the first member about said first axis is limited by the interference between the first stop member and the second stop member.

2. A light fixture comprising the combination of claim 1 and a mount for a light source, the mount being disposed for mounting a light source within the housing.

3. The combination of claim 1, said second member being disposed within the housing.

4. The combination of claim 1, further comprising means for selectively forcing together said opposed surfaces for inhibiting relative motion thereof.

5. The combination of claim 4, the base comprising a threaded post extending outwardly with respect to the housing and being fixed with respect to one of the first and second members, further comprising a threaded member threadedly received onto threads of the post.

6. The combination of claim 5, wherein the threaded member comprises means for pushing the housing with respect to the post so as to force together said opposed surfaces.

7. The combination of claim 4, further comprising means formed on at least one of the concave and convex surfaces for enhancing the inhibition of relative motion when said surfaces contact each other.

8. An apparatus for making an electric and a mechanical connection between an electric cable and an energy consuming unit, the apparatus comprising:

an energy consuming unit having a base and means for mounting an electric load;

a mount for mating with and fixedly supporting the base, said mount having an earth engaging portion configured for retention underground;

interlocking means formed on the mount and the base for attaching said mount into a locked fixed position with said base, the interlocking means defining a passage formed between a surface of the base and a surface of the mount, said interlocking means disposed adjacent said earth engaging portion so that an electrical connection may be established between the load and the cable proximate to the earth in the vicinity of the interlocking means;

penetrating means associated with said interlocking means and extending from said base into the passage for penetrating an electric cable disposed within the passage and contacting an electric conductor within the cable when said mount is attached to said base in a locked fixed position by said interlocking means, at least a portion of said penetrating means being electrically conductive; and means for providing an electric connection between the penetrating means and an electric load and further comprising a ball and socket coupling joining the base to a housing of the energy consuming unit.

9. The apparatus of claim 8, the coupling comprising opposed surfaces in the form of spherical segments, the apparatus comprising locking means disposed on the base for forcing together said opposed surfaces.

10. The apparatus of claim 8, wherein said means for providing an electric connection includes conducting means extending within said base from said penetrating means and passing through a portion of said ball and socket joint into an interior of the housing.

11. A joint for connecting a housing to a mounting member comprising:

a socket portion connected to the housing, said socket portion including a wall defining an interior and having a first opening in said wall in the form of a longitudinal slot;

a stem portion connected at a first end thereof to the mounting member and extending through and movable along the longitudinal slot in said wall;

a ball portion connected to a second end of said stem portion, said ball portion sized and adapted to be rotatable in said interior of said socket portion about an axis extending in a first direction perpendicular to the plane defined by said stem portion and the longitudinal slot, and rotatable in said interior of said socket portion about a second axis extending in a second direction orthogonal to said first direction and parallel to said stem portion;

a first stop member connected to said wall of said socket portion and extending into the interior of said socket portion;

a second stop member connected to said ball portion said second stop member positioned and adapted to interfere with said first stop member whereby rotation of said ball portion in said socket portion about said second axis is limited by the interference between said first stop member and said second stop member.

12. The joint of claim 11 in which the housing is adapted for use with a light therein and in which the mounting member is adapted for supporting the housing, further comprising:

a cable connected at one end thereof to the light inside the housing and passing through an opening through said ball portion and said stem portion to the mounting member whereby electrical current can be provided to the light in the housing through the joint.

13. The joint of claim 11 further comprising:

a fixing means adapted to fix the relative portion of the housing with the mounting member by frictionally engaging said socket portion with said ball portion.

14. The joint of claim 13 in which said fixing means further comprises:

a nut threadably adjustable upon said stem portion, said nut adapted to be adjusted to bear upon the housing portion whereby said ball portion and said socket portion may be brought into frictional engagement.

15. The joint of claim 11 in which said first stop portion is connected to said wall of said socket portion at a location at which said first axis intersects said wall portion.

16. An apparatus for making an electric and a mechanical connection between an electric cable and an energy consuming unit, the apparatus comprising:

an energy consuming unit having a base and means for mounting an electric load;

a mount for mating with and fixedly supporting the base, said mount having an earth engaging portion configured for retention underground;

interlocking means formed on the mount and the base for attaching said mount into a locked fixed position with said base, the interlocking means defining a passage formed between a surface of the base and a surface of the mount, said interlocking means disposed adjacent said earth engaging portion so that an electrical connection may be established between the load and the cable proximate to the earch in the vicinity of the interlocking means;

penetrating means associated with said interlocking means and extending from said base into the passage for penetrating an electric cable disposed within the passage and contacting an electric conductor within the cable when said mount is attached to said base in a locked fixed position by said interlocking means, at least a portion of said penetrating means being electrically conductive; and means for providing an electric connection between the penetrating means and an electric load and further comprising a raised portion on at least one of said surface of the base and said surface of the mount, said raised portion projecting into said passage and operable to force a cable onto piercing engagement with said penetrating means.

* * * * *

UNITED STATES PATENT AND TRADEMARK OFFICE

CERTIFICATE OF CORRECTION

PATENT NO. : 5,086,379
DATED : February 4, 1992
INVENTOR(S) : John F. Denison et al.

It is certified that error appears in the above-indentified patent and that said Letters Patent is hereby corrected as shown below:

In column 1, line 44, delete "being" and substitute therefor --been--.

In column 2, line 45, after "pitch" insert --,--.

In column 2, lines 53 and 54, delete "e)evated" and substitute therefor --elevated--.

In column 2, line 60, delete "liqht" and substitute therefor --light--.

In column 3, line 7, delete "shoWing" and substitute therefor --showing--.

In column 3, line 58, delete "12" and substitute therefor --42--.

In column 3, line 59, delete "21" and substitute therefor --24--.

UNITED STATES PATENT AND TRADEMARK OFFICE

CERTIFICATE OF CORRECTION

PATENT NO. : 5,086,379
DATED : February 4, 1992
INVENTOR(S) : John F. Denison et al.

It is certified that error appears in the above-indentified patent and that said Letters Patent is hereby corrected as shown below:

In column 3, line 66, after "38" insert --.--.

In column 6, line 54, after "button" delete ".".

Column 10:

In claim 16, line 24, delete "earch" and substitute therefor --earth--.

Signed and Sealed this

Eleventh Day of October, 1994

*Attest:*

*Attesting Officer*

Bruce Lehman

BRUCE LEHMAN

*Commissioner of Patents and Trademarks*